US005465834A

United States Patent [19]

Sieber et al.

[11] Patent Number: 5,465,834

[45] Date of Patent: Nov. 14, 1995

[54] FOLDING BOX WITH A SUBDIVIDED INTERIOR

[75] Inventors: Helmut Sieber; Ferdinand Schilling, both of Heidenheim; Günter Hagen, Leverkusen; Roland Kleissendorf, Bergisch Gladbach; Johannes Michaelis, Köln, all of Germany

[73] Assignees: Carl Edelmann GmbH, Heidenheim; Bayer Aktiengesellschaft, Leverkusen, both of Germany

[21] Appl. No.: 330,760

[22] Filed: Oct. 28, 1994

[30] Foreign Application Priority Data

Nov. 2, 1993 [DE] Germany ..... 43 37 382.8

[51] Int. Cl.[6] ..... B65D 75/00

[52] U.S. Cl. ..... 206/193; 206/427; 229/120.18

[58] Field of Search ..... 229/120.18; 206/427, 206/446, 193, 197

[56] References Cited

U.S. PATENT DOCUMENTS

| | | | |
|---|---|---|---|
| 3,047,204 | 7/1962 | Wolowicz . | |
| 3,240,417 | 3/1966 | Andreini . | |
| 3,563,449 | 3/1969 | Forbes, Jr. . | |
| 4,260,059 | 4/1981 | Roccaforte | 229/120.18 X |
| 4,601,390 | 7/1986 | Rosenthal et al. | 206/193 X |
| 4,706,805 | 11/1987 | Becher | 206/427 X |
| 5,065,937 | 11/1991 | Ritter | 206/193 X |

FOREIGN PATENT DOCUMENTS

| | | |
|---|---|---|
| 1375971 | 9/1964 | France . |
| 2316150 | 10/1974 | Germany . |
| 2159498 | 12/1985 | United Kingdom . |

*Primary Examiner*—Jacob K. Ackun

*Attorney, Agent, or Firm*—Sprung Horn Kramer & Woods

[57] ABSTRACT

A folded box with a subdivided interior contains a partition arrangement consisting of cardboard zones which are connected integrally to the folding-box blank. One of the partition zones is bonded to a main zone. A web extends transversely from the other partition zone, in the lower region of the compartment enclosed by the partition zones, through the compartment, the upper edge of the said web limiting the compartment downwards. In this way, two bottles of differing diameter and of differing height, the closing caps of which are located at the same height, can be safely accommodated in the folding box. The web provides the necessary height compensation.

5 Claims, 9 Drawing Sheets

FOLDING BOX WITH A SUBDIVIDED INTERIOR

The invention relates to a folding box made from cardboard with a subdivided interior for the reception of two bottles of different diameters and heights.

There are known cardboard packagings for bottles, the interior of which is subdivided by partitions into individual compartments which are each intended for the reception of a bottle. As a rule, in such cardboard packagings, bottles of uniform size are accommodated in a single-row or multi-row arrangement.

The packaging of bottles of different diameters and heights is one and the same cardboard packaging gives rise, in the known folding boxes with a subdivided interior, to problems both in transport and in handling during the extraction of the bottles. In the compartments of uniform size, the dimensions of which are coordinated with larger bottles, bottles of smaller diameter and smaller height have excessive mobility, and this can lead to breakage during transport. Bottles of smaller size are difficult to extract from the compartments, because it is necessary to reach deep into the compartments, and this can lead to injuries on sharp cardboard edges.

The object on which the invention is based is to specify a folding box which is adapted in a special way for the reception of two bottles of different diameters and heights.

This object is achieved by means of the features specified in claim 1. The subclaims relate to advantageous embodiments of the invention.

The invention specifies a folding box, in which two compartments, which are adapted to different bottle diameters and heights, are formed by means of a partition arrangement. A chamber of reduced cross-sectional dimensions, the lower region of which is subdivided by a web extending transversely through the chamber cross-section, is divided off in the folding box by a partition arrangement. A space remains in the chamber above the web and forms the compartment for a bottle of smaller diameter and of smaller height, the web forming a support for the bottom of the smaller bottle and thus ensuring height compensation. With the folding box opened, the consumer is presented with two bottles of differing size, the upper ends (closing flaps) of which lie at the same height, so that even the smaller of the bottles can be grasped easily.

Moreover, in special embodiments, a narrow slender compartment for receiving a spoon is formed by the partition arrangement, this being especially advantageous for the instance of use as a medicinal pack.

A particular advantage of the invention is that the folding box, including its partition arrangement, can be produced from a one-piece cardboard blank which can be delivered in a space-saving manner in a pre-bonded flat state to the filling location, where, in the conventional way, it can be erected, closed at the bottom and subsequently equipped with bottles and closed.

The invention is explained in more detail below by reference to the embodiments illustrated in the drawings. In these:

Figure 1:
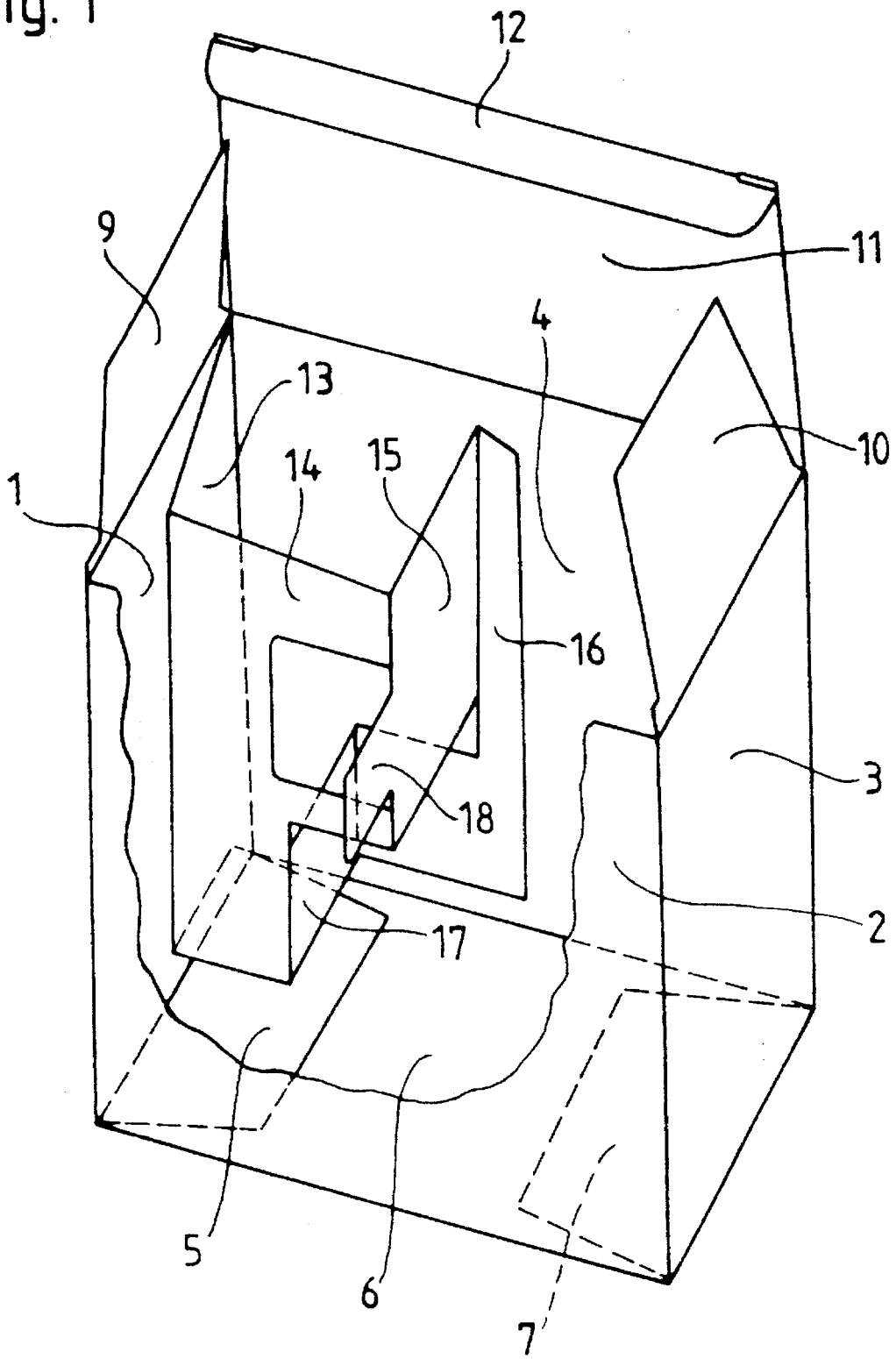
FIG. 1 shows a first embodiment of a folding box, one of the main zones being partially cut away in order to show the partition arrangement.
Figure 2:
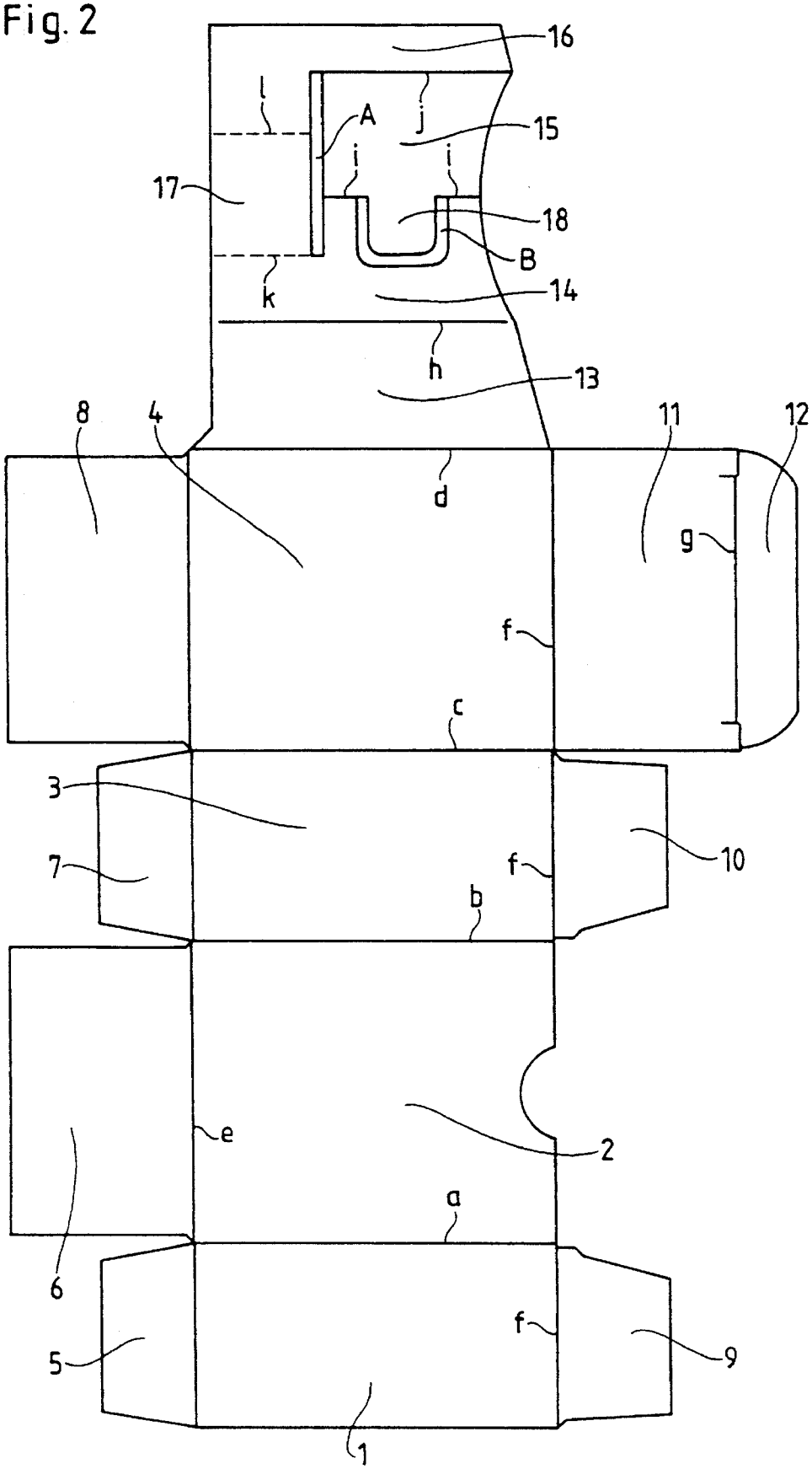
FIG. 2 shows the blank for the folding box according to FIG. 1.

According to FIGS. 1 and 2, the folding box according to FIG. 1 consists of two main zones 2 and 4 and of two side zones 1 and 3 which connect these to one another and which, in the blank according to FIG. 2, are arranged one behind the other, as well as of bottom folding flaps 5 and 7, which are attached to the side zones 1 and 3, and bottom flaps 6 and 8 which are attached to the main zones 2 and 4. Lid folding flaps 9 and 10 are attached to the side zones 1 and 3 opposite the bottom folding flaps 5 and 7, and a lid flap 11 with an insertion tab 12 is attached to one main zone 4. The carcass zones are delimited from one another by folding line a to c, and the folding flaps, lid flap and insertion tab are delimited from one another by folding lines e, f and g respectively. The folding box thus far has no special features, and therefore there is no need for a detailed explanation.

Attached laterally to the main zone 4 is a first adhesive tab 13 which is delimited from the main zone 4 by a folding line d. The first adhesive tab 13 has adjoining it on the far side of a folding line h a first partition zone 14 which a second partition zone 15 in turn adjoins on the far side of a folding line i. The termination is formed by a second adhesive tab 16 which extends on the far side of a further folding line j.

The second partition zone 15 is limited, on the side facing the bottom of the folding box, by a continuous cut line A which continues approximately over half the width of the first partition zone 14 into the latter. A folding line k extends in the first partition zone 14 from the end of this cut line A in the first partition zone 14 as far as the bottom edge of the latter. At a distance from the folding line j corresponding to the distance between the folding line k and the folding line h, a folding line I extends from the cut line A in that cardboard portion which is delimited by this cut line and which, in the finished folding box, is located underneath the cut line A. A web 17 is thereby delimited between the folding line k and l.

It may be emphasised at this juncture that the cut line can have a width of approximately up to 3 mm, thus making it easier to erect the folding box.

In the example illustrated, the folding line i is subdivided. It consists of two part segments, between which a U-shaped cut line B extends into the first partition zone 14, starting from the ends of the folding-line segments i, and borders a tag 18 there. This cut line too can have a particular width of up to approximately 2 mm. The partition zone 14 and the tag 18 together have a width which is preferably approximately as large as the width of a side zone 1 or 3, but is not larger than this.

Figure 3:
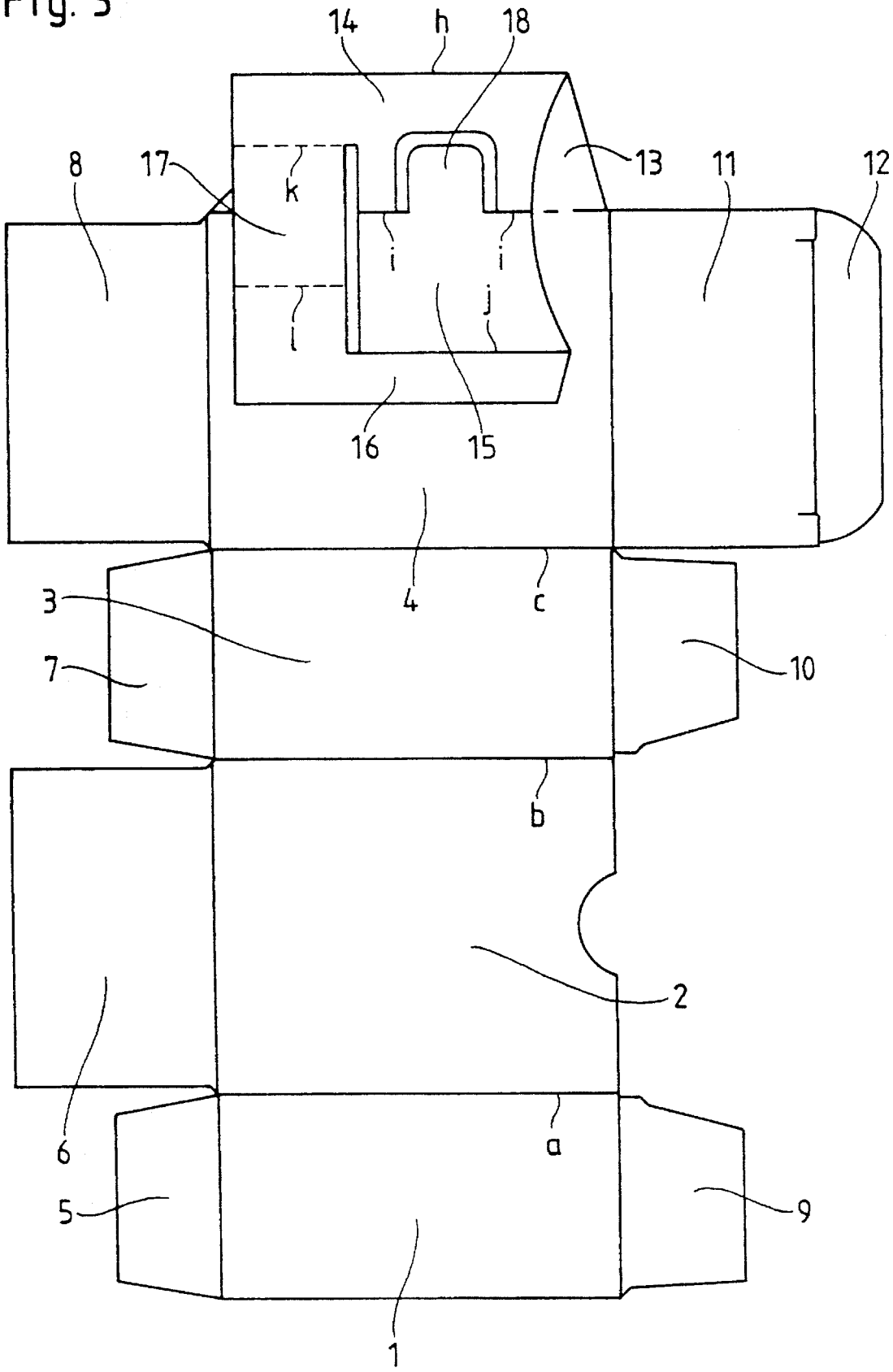
FIG. 3 shows the blank according to FIG. 2 in the part-bonded state.

To produce the folding box according to FIG. 1, the first partition zone 14 is folded round through 180° at the folding line h, and this partition zone, together with the second partition zone 15, the web 17 and the second adhesive tab 16, is laid round onto the inside of the first adhesive tab 13 and the main zone 4, where the second adhesive tab 16 is bonded to the main zone 4. This intermediate state is shown in FIG. 3.

Moreover, the blank is folded round at the folding lines c and a through 180° in each case, and the inside of the side zone 1 is bonded, at least in the region of its free edge, to the outside of the first adhesive tab 13. The pre-bonded blank is thus completed for delivery to the filling location.

During the erection of the blank to form the folding box, in the interior of the latter the partition zones 14 and 15 and the web 17 are also erected automatically and result in the three-dimensional shape illustrated in FIG. 1, thereby forming in the interior of the folding box a compartment which is limited downwards by the upper edge of the web 17. The tag 18, limited by the U-shaped cut B and formed on the second partition zone 15, projects towards the main zone 2. When the tag 18, together with the second partition zone 15, has the said total width which is as large as that of a side zone 1 or 3, the front edge of the tag 18 is close opposite the inner wall of the main zone 2 or even touches this.

By means of this tag 18, there is formed in the interior of the folding box, between the compartment enclosed by the partition arrangement consisting of the partition zones 14 and 15 and the inner wall of the main zone 2, a further small compartment which reaches as far as the bottom of the folding box and which can be utilized for the reception of a relatively flat article, for example a spoon.

In the erected state of the folding box, the bottom folding flaps 5 and 7 and the bottom flaps 6 and 8 can be folded in and bonded to one another, as is generally conventional, and, after the filling of the folding box, the latter can be closed in the customary way by folding round the lid folding flaps 9 and 10 and the lid flap 11 and inserting the insertion tab 12.

It can be seen that, in the folding box according to FIG. 1, two compartments of different cross-sectional dimensions and different heights are formed, so that two bottles of different diameters and heights can be accommodated, and after the folding box has been opened the consumer is presented with the said two bottles at the same height as a result of the height compensation provided by the web 17. In order to make it easier to grasp the bottle of smaller dimensions, the upper edges of the partition zones are made arcuate, as is evident in FIGS. 2 and 3, but they can also be bevelled rectilinearly, as shown in FIG. 1.

It may be mentioned that the tag 18 can also be omitted, if there is no need to accommodate a third article in the folding box.

Figure 4:
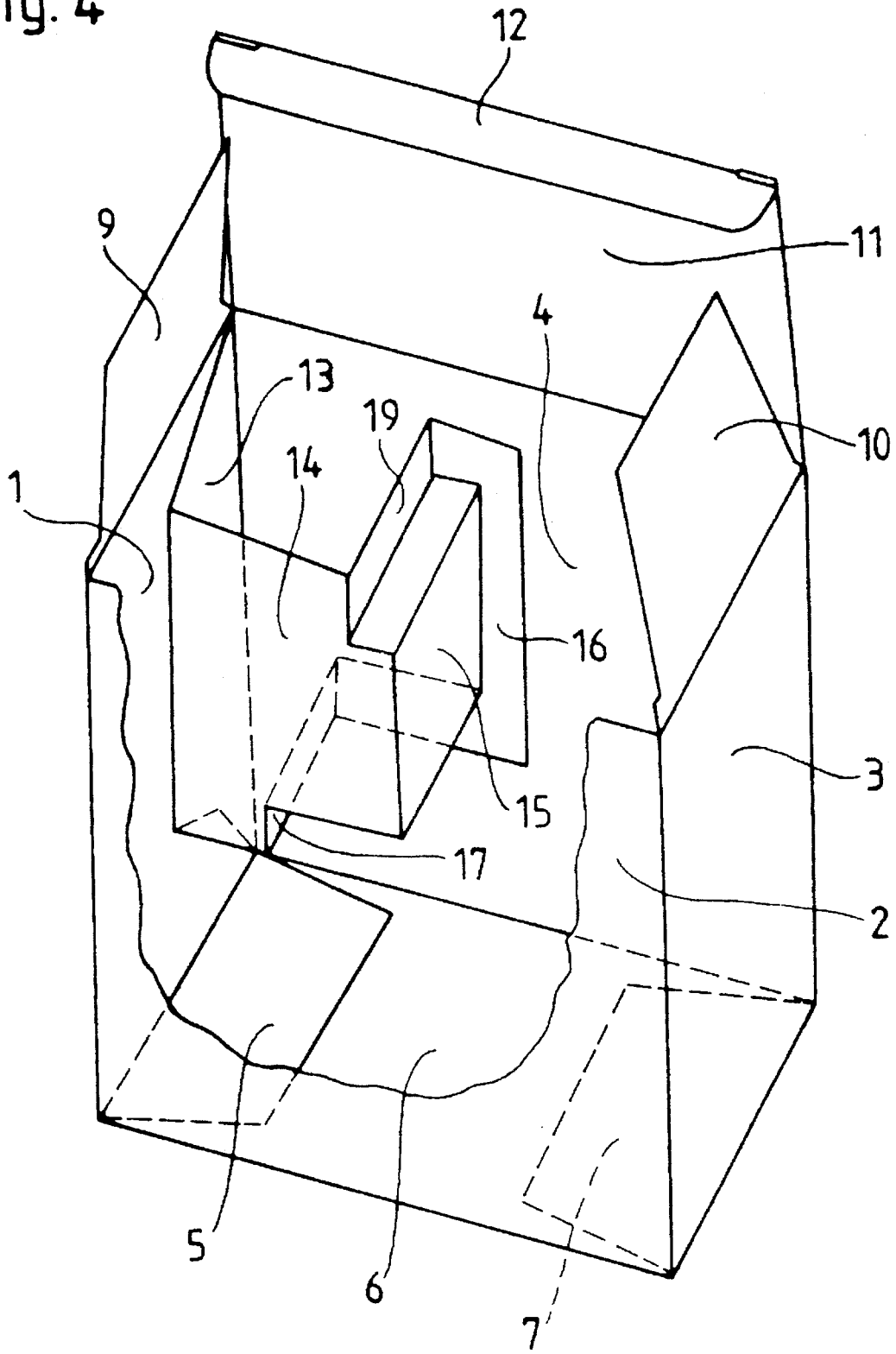
FIG. 4 shows a second embodiment of the invention.
Figure 5:
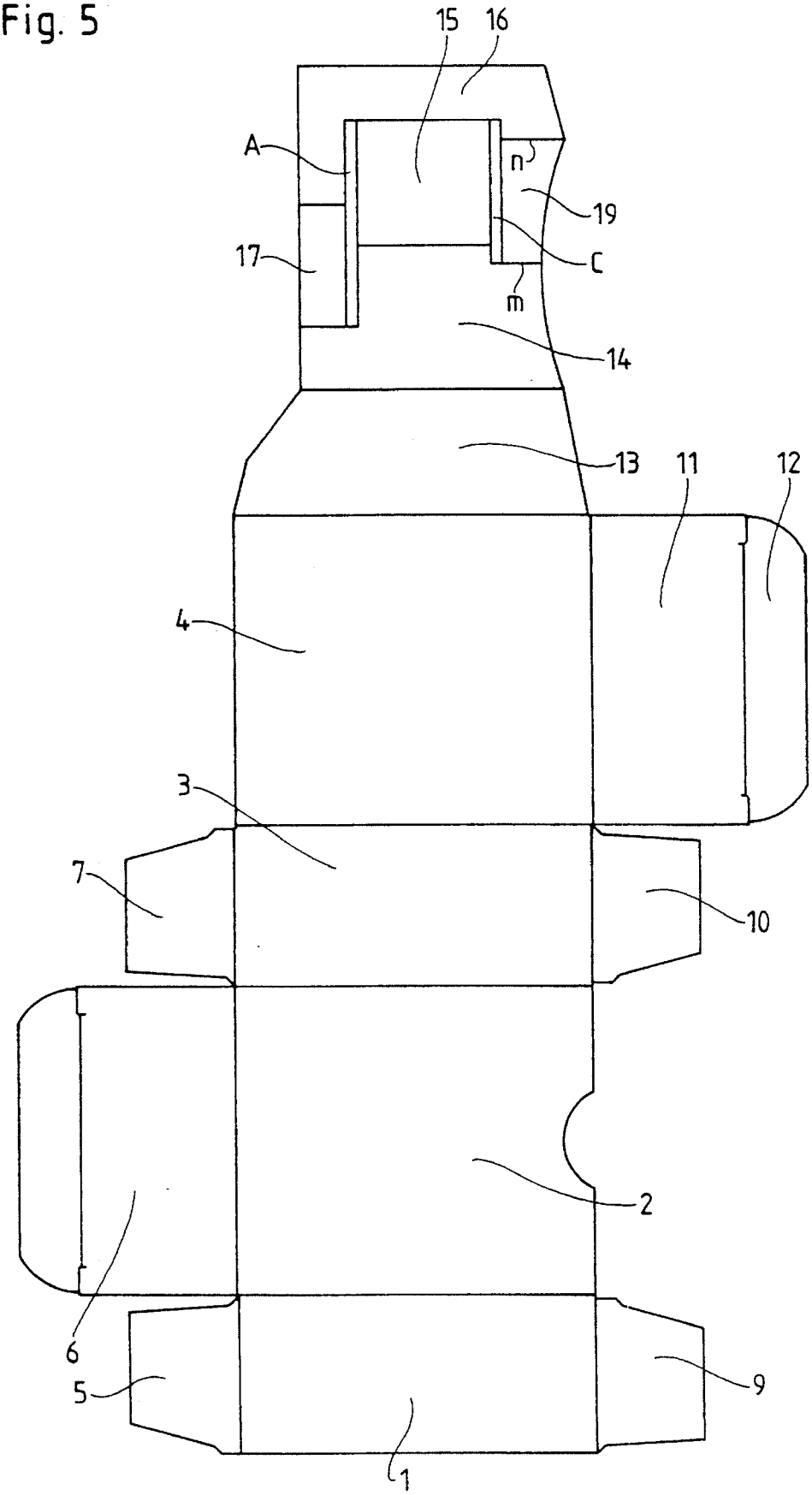
FIG. 5 shows the blank for the folding box according to FIG. 4.
Figure 6:
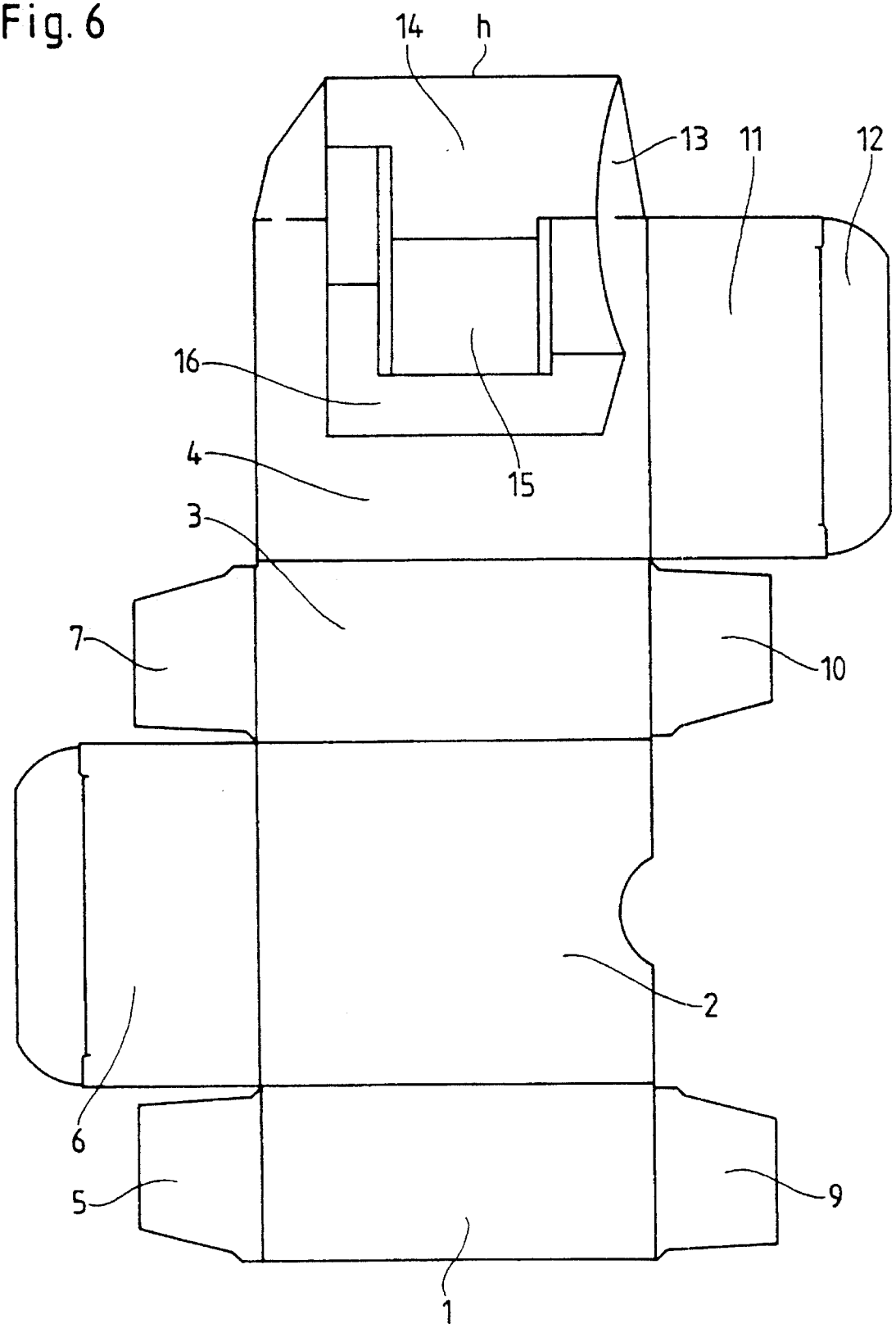
FIG. 6 shows the blank according to FIG. 5 in the part-bonded state.

The second embodiment illustrated in FIGS. 4 to 6 differs from the first embodiment in that there is formed on the side facing the larger compartment, in the smaller compartment, an additional web 19 which narrows the free cross-section of the latter in the upper region. This web 19 is limited by a cut line C which runs parallel to the cut line A and which extends over the entire width of the second partition zone 15 and over approximately 1 cm into the first partition zone 14. A folding line m extends from the end of the cut line C located in the first partition zone 14 as far as the upper edge of the first partition zone 14, and a corresponding folding line n extends at a distance of 1 cm from the other end of the cut line C as far as the free edge of the second partition zone 15. The said web 19 is formed between the two folding lines m and n and narrows the free cross-section of the smaller compartment.

It can be seen in FIG. 4 that a narrow rectangular orifice is thereby formed between the lower edge of the web 19 and the upper edge of the second partition zone 15, through which edge a flat article, for example a spoon, can be pushed into the smaller compartment from above.

In this embodiment too, the smaller compartment is limited downwards by the upper edge of the web 17. The height of the web 17 or, more precisely, the distance between its upper edge and the bottom of the folding box depends on the height of the bottle which is to be accommodated in the smaller compartment.

The production of this folding box takes place in a comparable way to the folding box according to FIG. 1. The first partition zone 14 is folded round at the folding line h, the second adhesive tab 16 is bonded to the main zone 4 (see FIG. 6), and subsequently the inside of the side zone 1 is bonded, at least in its free edge region, to the outside of the first adhesive tab 13. Erection, bottom-closing, filling and lid-closing take place in the customary way.

Figure 7:
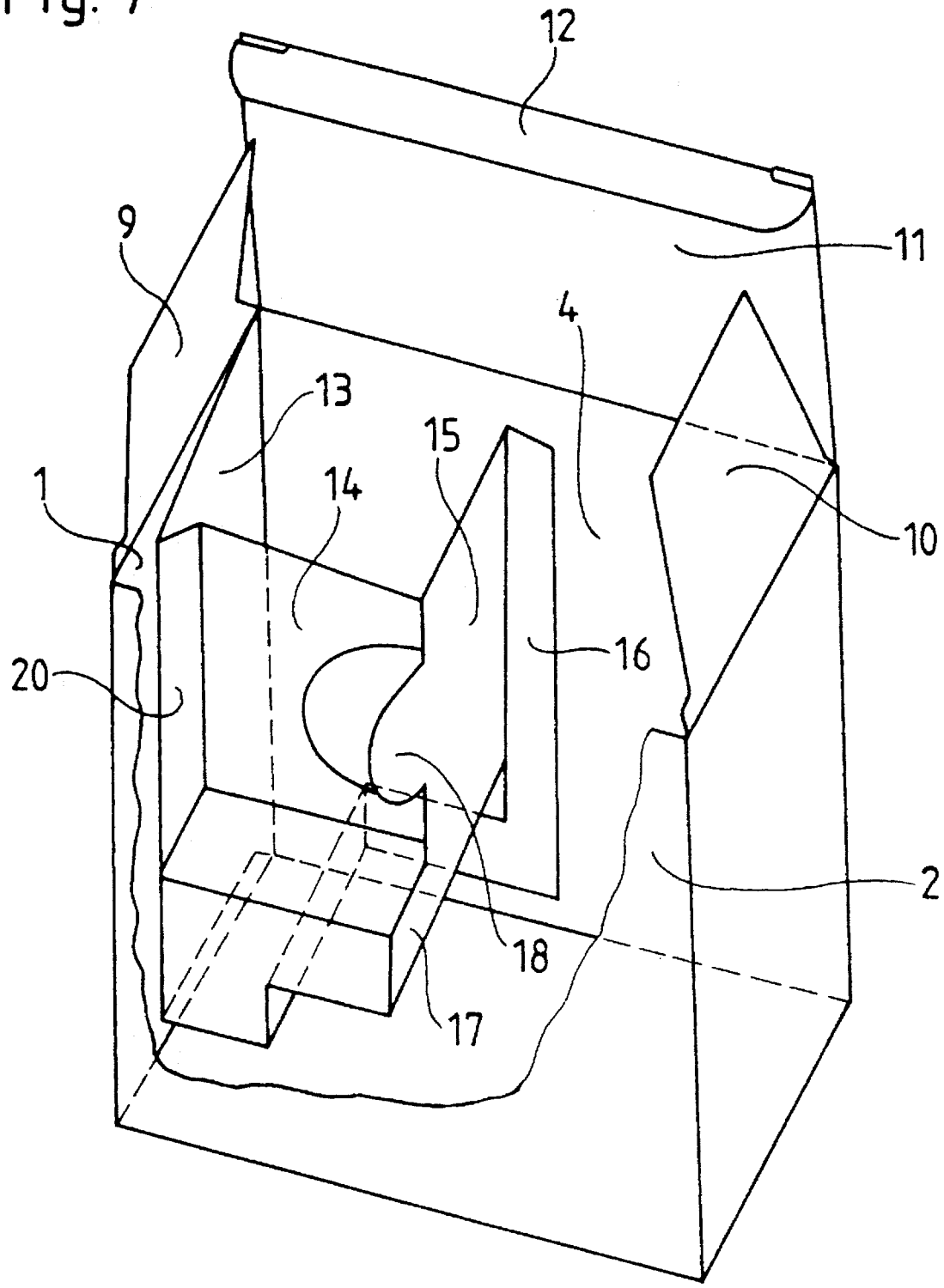
FIG. 7 shows a third embodiment of the invention.

FIG. 7 shows a third embodiment of the invention which differs from the first and second embodiments in that there is formed laterally next to the smaller compartment a reception compartment for a flat article, for example a spoon, which is limited downwards by the web 17 forming the lower termination of the smaller compartment.

Figure 8:
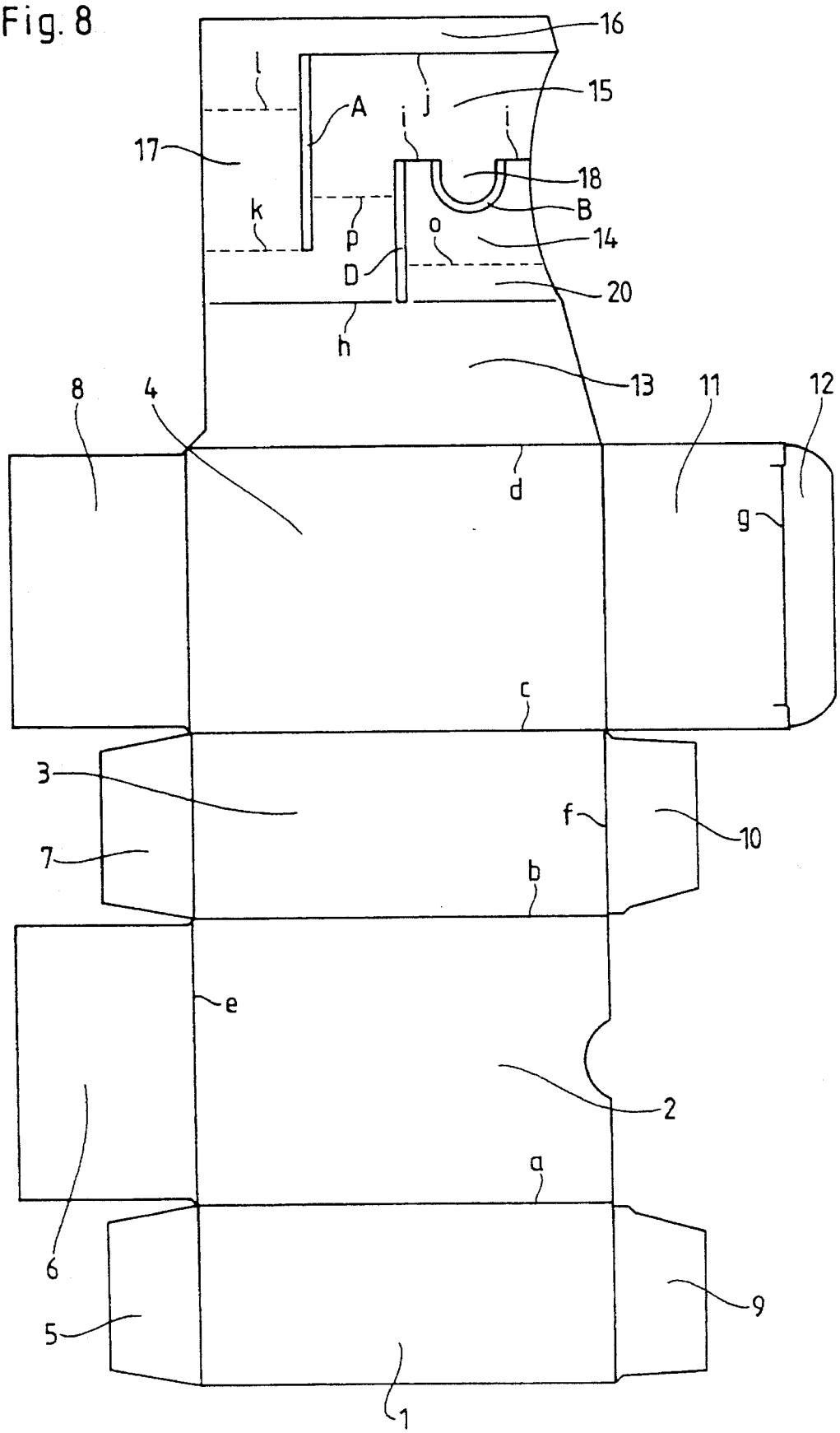
FIG. 8 shows the blank for the folding box according to FIG. 7.
Figure 9:
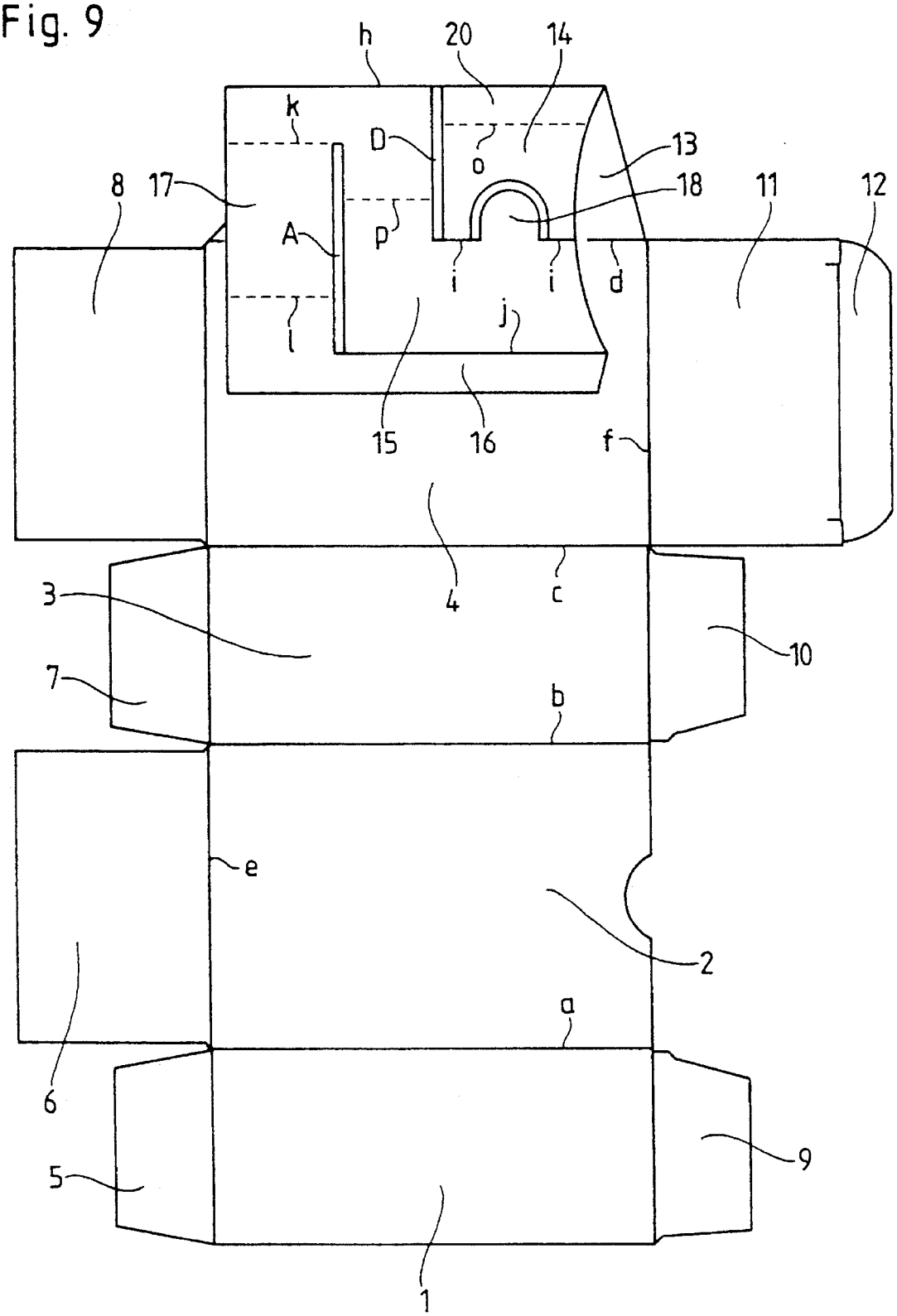
FIG. 9 shows the blank according to FIG. 8 in the part-bonded state.

According to FIGS. 7 to 9, the first partition zone 14 is limited at its lower end by a cut line D which extends over the entire width of the first partition zone 14 and which runs parallel to the cut line A. The first partition zone 14 is connected to the first adhesive tab 13 via a cardboard strip 20 which is delimited from the first adhesive tab 13 by the folding line h and from the first partition zone 14 by a folding line o. The cut line D runs as far as the folding line h and thus also limits the cardboard strip 20 on one side. At a distance, corresponding to the width of the cardboard strip 20, from the folding line i which delimits the first and second partition zones 14 from one another, a folding line p extends from the cut line d as far as the cut line A in the cardboard region located between the cut lines D and A. The blank according to FIG. 8 otherwise corresponds to the blank according to FIG. 2.

To produce the folding box illustrated in FIG. 7, the cardboard material is first folded round onto the first adhesive tab 13 and the main zone 4 on the far side of the folding line h. The cardboard strip 20 is bonded to the inside of the first adhesive tab 13 and the second adhesive tab 16 is bonded to the main zone 4. This state is shown in FIG. 9. The cardboard material is folded through 180° at the folding line c, and subsequently the side zone 1 is folded at the folding line a onto the outside of the first adhesive tab 13, and the side zone 1 is bonded, at least in the region of its free edge, to the outside of the first adhesive tab 13. In this state, the pre-bonded blank can be delivered flat to the filling location.

At the filling location, the pre-bonded blank is erected to form the folding box and is closed at the bottom. The shape of the folding box illustrated in FIG. 7 is obtained thereby. It can be seen that, on the side, facing the main zone 2, of the smaller compartment formed by the partition arrangement, there is formed outside this compartment a reception space which is limited downwards by the upper edge of the web 17 and which is limited laterally on one side by the cardboard strip 20 bonded to the first adhesive tab 13 and on the other side by the tag 18. This space is suitable for the reception of a flat article, for example a spoon. The smaller compartment is limited downwards by the upper edge of the web 17 and laterally by the first adhesive tab 13, the main zone 4 and the partition zones 14 and 15.

We claim:

1. Folding box for the reception of two bottles of different diameters and heights, consisting of a cuboid carcass formed from two main zones (2, 4) and from two side zones (1, 3) connecting these to one another, of folding flaps (5, 7, 9, 10) which are attached to the side zones (1, 3) and are located at the two respective ends of the side zones (1, 3) and which are delimited from the side zones (1, 3) by folding lines (e, f), of a bottom flap (6; 8) on at least one of the main zones (2, 4), the bottom flaps and lid flaps being delimited from the respective main zone (2, 4) by folding line (e, f), and of a first adhesive tab which is attached laterally to one of the carcass zones (4) and is delimited from this by means of a folding line (d) and which is bonded to one (1) of the said side zones (1, 3) which is attached only to the other main zone (2) via a folding line (a), characterized in that there is attached to the edge of the first adhesive tab (13), which is located opposite that edge at which the first adhesive tab (13) is connected to the main zone (4), a first partition zone (14) which is delimited from the adhesive tab (13) at the respective edge by a folding line (h), and in that there is attached to the first partition zone (14) a second partition zone (15) which, in its portion facing the lid flap (11), is delimited from the first partition zone (14) by a folding line (i) which runs parallel to the folding line (h) delimiting the first adhesive tab (13) from the first partition zone (14), and in that the second partition zone (15) has, at its end facing away the first partition zone (14), a second adhesive tab (16) which is delimited from the second partition zone (15) by means of a folding line (j) and which is bonded to the main zone (4) to which the first adhesive tab (13) is attached, the first and second adhesive tabs (13, 16) being at a distance from one another which is as large as the distance between the folding lines (h, i) which delimit the first partition zone (14), and in that a straight (first) cut line (A) extends perpendicularly to the said folding lines underneath the upper portion of the second partition zone (15) over the entire width of the latter and continuously over approximately half the width of the first partition zone (14) at a predetermined distance from the bottom of the folding box, and at the end of this cut line, in the first partition zone (14) and approximately in the middle of the width of the second partition zone (15), in each case one folding line (k, l), starting from the cut line (A) extends continuously in the direction of the bottom of the folding box, the last-mentioned folding lines (k, l) limiting between them a non-folded web (17) which divides the lower portion of a chamber delimited in the folding box from the partition zones (14, 15).

2. Folding box according to claim 1, characterized in that there is formed in the first partition zone (14), above the straight cut line (A), an essentially U-shaped cut line (B), the two ends of which commence at the folding line (i) which delimit the two partition zones (14, 15) from one another, and a tag (18) limited by the U-shaped cut line (B) and formed on the second partition zone (15) is connected, without a folding line, to the second partition zone (15).

3. Folding box according to claim 2, characterized in that the second partition zone (15) and tag (18) together have a width which is as large as the width of a side zone (1, 3) of the carcass of the folding box.

4. Folding box according to claim 1, characterized in that a second straight cut line (C) extends perpendicularly to the folding lines (a to d) and parallel to the first cut line (A), above the latter, over the entire width of the second partition zone (15) and over approximately 1 cm of the first partition zone (14), and at the end of the second cut line (C), in the first partition zone (14) and at a distance of approximately 1 cm from the folding line (j) delimiting the second adhesive tab (16) and located in the second partition zone (15), in each case folding lines (m, n), starting from the cut line (c), extend as far as the upper edge of the partition zones (14, 15) and limit between them a non-folded web (19) which narrows, in its free cross-section by approximately 1 cm, the upper region of the compartment limited by the partition zones (14, 15).

5. Folding box according to claim 1, characterized in that there is formed in the first partition zone (14), approximately in the middle between the lower and the upper end of the latter, a second cut line (D) which runs perpendicularly to the folding lines (a to d) and which extends over the entire first partition zone (14) and approximately 1 to 2 cm into the second partition zone (15), a folding line (o), which delimits the first partition zone (14) from the first adhesive tab (13), starting from the second cut line (D), extends at a distance of approximately 1 to 2 cm from the folding line (h) delimiting the first partition zone (14) from the first adhesive tab (13), parallel to the latter, as far as the upper end of the first partition zone (14), and the strip (20), of the first partition zone (14), included between this folding line (o) and the folding line (h) at the first adhesive tab (13) is bonded to the first adhesive tab (13) and the folding line (i) delimiting the upper region of the first partition zone (14) from the second partition zone (15), starting from the end of the second cut line (D) located in the second partition zone (15), extends as far as the upper end of the partition zones (14, 15).

* * * * *